US007115026B2

(12) United States Patent
Nakajima et al.

(10) Patent No.: US 7,115,026 B2
(45) Date of Patent: Oct. 3, 2006

(54) POLISHING APPARATUS

(75) Inventors: Makoto Nakajima, Nagano (JP); Yoshio Nakamura, Nagano (JP); Tadakazu Miyashita, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 11/201,307

(22) Filed: Aug. 11, 2005

(65) Prior Publication Data

US 2006/0035571 A1 Feb. 16, 2006

(30) Foreign Application Priority Data

Aug. 12, 2004 (JP) ..... 2004-235213

(51) Int. Cl.
*B24B 7/22* (2006.01)

(52) U.S. Cl. ..... 451/291; 451/287; 451/290

(58) Field of Classification Search ..... 451/285, 451/291, 290, 287, 286, 41
See application file for complete search history.

(56) References Cited

U.S. PATENT DOCUMENTS 2,963,830 A * 12/1960 Hook ..... 451/286
3,848,365 A * 11/1974 Bovensiepen et al. ..... 451/28
4,315,383 A * 2/1982 Day ..... 451/269
4,593,495 A * 6/1986 Kawakami et al. ..... 451/269
5,099,614 A * 3/1992 Arai et al. ..... 451/8
5,595,529 A * 1/1997 Cesna et al. ..... 451/291
5,697,832 A * 12/1997 Greenlaw et al. ..... 451/291

FOREIGN PATENT DOCUMENTS

JP 11-48126 A 2/1999

* cited by examiner

*Primary Examiner*—Robert A. Rose
(74) *Attorney, Agent, or Firm*—Birch, Stewart, Kolasch and Birch, LLP

(57) ABSTRACT

An upper polishing plate is moved downward until facing a lower polishing plate to polish a work piece. The upper polishing plate is rotated in a horizontal plane together with a first elastic member, a second elastic member, an outer member and a connecting member. A pressure difference between a first pressing force pressing the outer member or an inner member upward and a second pressing force pressing the outer member or the inner member downward, which is produced in a first closed space by supplying a compressed fluid into and discharging the same from the first closed space, is adjusted, so that a third pressing force of the upper polishing plate, which presses a work piece, can be adjusted.

12 Claims, 5 Drawing Sheets

POLISHING APPARATUS

BACKGROUND OF THE INVENTION

The present invention relates to a polishing apparatus for polishing thin work pieces, e.g., wafers.

A conventional polishing apparatus is disclosed in Japanese Patent Gazette No. 11-48126. The polishing apparatus is shown in FIG. 7. In the polishing apparatus 10, an upper polishing plate 12 is vertically moved by a cylinder unit 14 provided on a base 13 together with a rod 14*a*, a connecting section 14*b*, a rotary plate 15 and connecting rods 16. The connecting section 14 includes a suitable mechanism, e.g., universal joint, for rotating the upper polishing plate 12 along an upper face of a lower polishing plate 18. Keys 19 are engaged with key grooves of a rotor head 20. With this structure, the upper polishing plate 12 is rotated in a horizontal plane by a motor with a shaft 20*a*, gears and a reduction gear unit 21. On the other hand, the lower polishing plate 18 is rotated by the motor 22 with a hollow shaft 18*a*, gears and the reduction gear unit 21. A sun gear 23 is rotated by the motor 22 with a shaft 23*a*, gears and the reduction gear unit 21. An internal gear 24 is also rotated by the motor 22 with a shaft 24*a*, gears and the reduction gear unit 21. Carriers 25 are engaged with the sun gear 23 and the internal gear 24, so that the carriers 25 perform sun-and-planet motion. A work piece 26 is fitted in a through-hole of each carrier 25 and moved together with the carrier 25. By rotating the polishing plates 12 and 18, both surfaces of each work piece 26 can be polished.

In the apparatus 10, an upper polishing plate 12 is suspended by a cylinder unit 14 while polishing work pieces 26. A pressing force of the upper polishing plate 12, which is applied to the work pieces 26, is adjusted by adjusting pressure of a pressurized fluid, which is supplied to a lower cylinder chamber of the cylinder unit 14. By adjusting the pressure, the pressing force from the upper polishing plate 12 to the work pieces 26 can be adjusted in a range, which is from a force smaller than weight of the upper polishing plate 12 to a force equal to the weight of the upper polishing plate 12. Note that, the pressing force greater than the weight of the upper polishing plate 12 can be applied to the work pieces 26 by supplying the pressurized fluid to an upper cylinder chamber of the cylinder unit 14.

However, the conventional polishing apparatus 10 has following disadvantages.

Firstly, a piston, which is provided to an upper end of a rod 14*a* of the cylinder unit 14, slides on an inner face of a cylinder of the cylinder unit 14. Therefore, friction is generated between a seal member of the piston and the inner face of the cylinder, so that it is difficult to precisely control the vertical movement of the upper polishing plate 12. Especially, when the cylinder unit 14 is actuated from a stopping state, friction coefficient is changed from a high static frictional coefficient to a low dynamic frictional coefficient, so that knocking easily occurs.

Driving forces for driving the polishing plates 12 and 18, the sun gear 23 and the internal gear 24 are transmitted by various gears, and the keys 19 are engaged with the key grooves of the rotor head 20 connected to the upper polishing plate 12. Therefore, backlashes are occurred between gears and between keys 19 and the key grooves, so that vibrations easily occur therebetween. If the work pieces 26 are thin, they will be damaged or broken by the vibrations.

SUMMARY OF THE INVENTION

The present invention has been invented to solve the disadvantages of the conventional polishing apparatus.

An object of the present invention is to provide a polishing apparatus, which is capable of linearly and precisely controlling a pressing force applied from an upper polishing plate to a work piece and which is capable of suitably polishing a thin work piece.

To achieve the object, the present invention has following structures.

Namely, the polishing apparatus of the present invention comprises:

a lower polishing plate;

an upper polishing plate being relatively moved with respect to the lower polishing plate so as to polish a work piece clamped between the lower polishing plate and upper polishing plate; and a holding mechanism for holding the upper polishing plate, wherein the holding mechanism includes:

an inner member;

an outer member having an upper open end and a lower open end, the outer member accommodating the inner member;

a first elastic member being made of an elastic material and formed into a ring-shape with a prescribed width, the first elastic member connecting an upper part of the inner member and an upper part of the outer member and closing the upper open end of the outer member;

a second elastic member being made of an elastic material and formed into a ring-shape with a prescribed width, the second elastic member connecting a lower part of the inner member and a lower part of the outer member and closing the lower open end of the outer member;

a first closed space being enclosed by an outer face of the inner member, an inner face of the outer member, the first elastic member and the second elastic member; and a fluid supply section supplying a pressurized fluid into the first closed space, one of the inner member and the outer member is connected to a rotary drive unit, the other is connected to the upper polishing plate, and the upper polishing plate is rotated in a horizontal plane, by the rotary drive unit, with the inner member and the outer member, and a pressure difference between a first pressing force pressing the outer member or the inner member upward and a second pressing force pressing the outer member or the inner member downward, which is produced in the first closed space by supplying the compressed fluid into and discharging the same from the first closed space, is adjusted so as to adjust a third pressing force of the upper polishing plate, which presses the work piece, while polishing the work piece.

Another polishing apparatus of the present invention comprises:

a lower polishing plate;

an upper polishing plate being relatively moved with respect to the lower polishing plate so as to polish a work piece clamped between the lower polishing plate and upper polishing plate; and a holding mechanism for holding the upper polishing plate, wherein the holding mechanism includes:

an inner member;

an outer member having an upper open end and a lower open end, the outer member accommodating the inner member;

a first elastic member being made of an elastic material and formed into a ring-shape with a prescribed width, the first elastic member connecting an upper part of the inner member and an upper part of the outer member and closing the upper open end of the outer member;

a second elastic member being made of an elastic material and formed into a ring-shape with a prescribed width, the second elastic member connecting a lower part of the inner member and a lower part of the outer member and closing the lower open end of the outer member;

a first closed space being enclosed by an outer face of the inner member, an inner face of the outer member, the first elastic member and the second elastic member;

a fluid supply section supplying a pressurized fluid into the first closed space;

a rotary drive unit to which one of the inner member and the outer member is connected;

a connecting member connecting the other of the inner member and the outer member to the upper polishing plate; and a vertical drive unit being provided above the upper polishing plate, the vertical drive unit vertically moving the rotary drive unit and the upper polishing plate with respect to the lower polishing plate, and the upper polishing plate is downwardly moved to face the lower polishing plate by the vertical drive unit, the upper polishing plate is rotated in a horizontal plane, by the rotary drive unit, with the inner member, the outer member and the connecting member, and a pressure difference between a first pressing force pressing the outer member or the inner member upward and a second pressing force pressing the outer member or the inner member downward, which is produced in the first closed space by supplying the compressed fluid into and discharging the same from the first closed space, is adjusted so as to adjust a third pressing force of the upper polishing plate, which presses the work piece, while polishing the work piece.

In the polishing apparatus, the first pressing force may be greater than the second pressing force, and a range of the third pressing force may be from a force smaller than a weight of the upper polishing plate to a force equal to the weight thereof.

In the polishing apparatus, the first pressing force may be smaller than the second pressing force, and a range of the third pressing force may be from a force greater than a weight of the upper polishing plate to a force equal to the weight thereof.

In the polishing apparatus, a torque for rotating one of the inner member and the outer member may be transmitted to the other by the first elastic member and the second elastic member.

In another case, the torque for rotating one of the inner member and the outer member may be transmitted to the other by a transmission pin.

Further, the polishing apparatus of the present invention comprises:

a lower polishing plate;

an upper polishing plate being relatively moved with respect to the lower polishing plate so as to polish a work piece clamped between the lower polishing plate and upper polishing plate; and a holding mechanism for holding the upper polishing plate, wherein the holding mechanism includes:

an inner member;

an outer member having an upper open end and a lower open end, the outer member accommodating the inner member;

a third elastic member being made of an elastic material and formed into a ring-shape with a prescribed width, the third elastic member connecting an upper part of the inner member and an upper part of the outer member and closing the upper open end of the outer member;

a fourth elastic member being made of an elastic material and formed into a ring-shape with a prescribed width, the fourth elastic member connecting a mid part of the inner member and a mid part of the outer member and closing a gap therebetween;

a fifth elastic member being made of an elastic material and formed into a ring-shape with a prescribed width, the fifth elastic member connecting a lower part of the inner member and a lower part of the outer member and closing the lower open end of the outer member;

a second closed space being enclosed by an outer face of the inner member, an inner face of the outer member, the third elastic member and the fourth elastic member;

a third closed space being enclosed by the outer face of the inner member, the inner face of the outer member, the fourth elastic member and the fifth elastic member;

a first fluid supply section supplying a pressurized fluid into the second closed space;

a second fluid supply section supplying a pressurized fluid into the third closed space, one of the inner member and the outer member is connected to a rotary drive unit, the other is connected to the upper polishing plate, and the upper polishing plate is rotated in a horizontal plane, by the rotary drive unit, with the inner member, the outer member and a connecting member, and a pressure difference between a first pressing force pressing the outer member or the inner member upward and a second pressing force pressing the outer member or the inner member downward, which is produced in the second closed space and/or the third closed space by supplying the compressed fluid into and discharging the same from the second closed space and/or the third closed space, is adjusted so as to adjust a third pressing force of the upper polishing plate, which presses the work piece, while polishing the work piece.

Further, the polishing apparatus of the present invention comprises:

a lower polishing plate;

an upper polishing plate being relatively moved with respect to the lower polishing plate so as to polish a work piece clamped between the lower polishing plate and upper polishing plate; and a holding mechanism for holding the upper polishing plate, wherein the holding mechanism includes:

an inner member;

an outer member having an upper open end and a lower open end, the outer member accommodating the inner member;

a third elastic member being made of an elastic material and formed into a ring-shape with a prescribed width, the third elastic member connecting an upper part of the inner member and an upper part of the outer member and closing the upper open end of the outer member;

a fourth elastic member being made of an elastic material and formed into a ring-shape with a prescribed width, the fourth elastic member connecting a mid part of the inner member and a mid part of the outer member and closing a gap therebetween;

a fifth elastic member being made of an elastic material and formed into a ring-shape with a prescribed width, the fifth elastic member connecting a lower part of the inner member and a lower part of the outer member and closing the lower open end of the outer member;

a second closed space being enclosed by an outer face of the inner member, an inner face of the outer member, the third elastic member and the fourth elastic member;

a third closed space being enclosed by the outer face of the inner member, the inner face of the outer member, the fourth elastic member and the fifth elastic member;

a first fluid supply section supplying a pressurized fluid into the second closed space;

a second fluid supply section supplying a pressurized fluid into the third closed space;

a rotary drive unit to which one of the inner member and the outer member is connected;

a connecting member connecting the other of the inner member and the outer member to the upper polishing plate; and a vertical drive unit being provided above the upper polishing plate, the vertical drive unit vertically moving the rotary drive unit and the upper polishing plate with respect to the lower polishing plate, and the upper polishing plate is downwardly moved to face the lower polishing plate by the vertical drive unit, the upper polishing plate is rotated in a horizontal plane, by the rotary drive unit, with the inner member, the outer member and the connecting member, and a pressure difference between a first pressing force pressing the outer member or the inner member upward and a second pressing force pressing the outer member or the inner member downward, which is produced in the second closed space and/or the third closed space by supplying the compressed fluid into and discharging the same from the second closed space and/or the third closed space, is adjusted so as to adjust a third pressing force of the upper polishing plate, which presses the work piece, while polishing the work piece.

In the polishing apparatus, the first pressing force generated in the second closed space may be greater than the second pressing force therein, and the first pressing force generated in the third closed space may be smaller than the second pressing force therein, whereby a range of the third pressing force is from a force smaller than a weight of the upper polishing plate to a force greater than the weight thereof In the polishing apparatus, the first pressing force generated in the second closed space may be smaller than the second pressing force therein, and the first pressing force generated in the third closed space may be greater than the second pressing force therein, whereby a range of the third pressing force is from a force greater than a weight of the upper polishing plate to a force smaller than the weight thereof In the polishing apparatus, an engage section, which is capable of restraining relative downward displacement of the inner member and the outer member, may be provided between the inner member and the outer member.

In the polishing apparatus, the rotary drive unit may be a direct drive motor.

By employing the polishing apparatus of the present invention, the pressing force applied from the upper polishing plate to the work piece can be linearly and precisely controlled, so that the work piece, especially the thin work piece, can be suitably polished.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Firstly, a first embodiment will be explained with reference to FIGS. 1–4.

Figure 1:
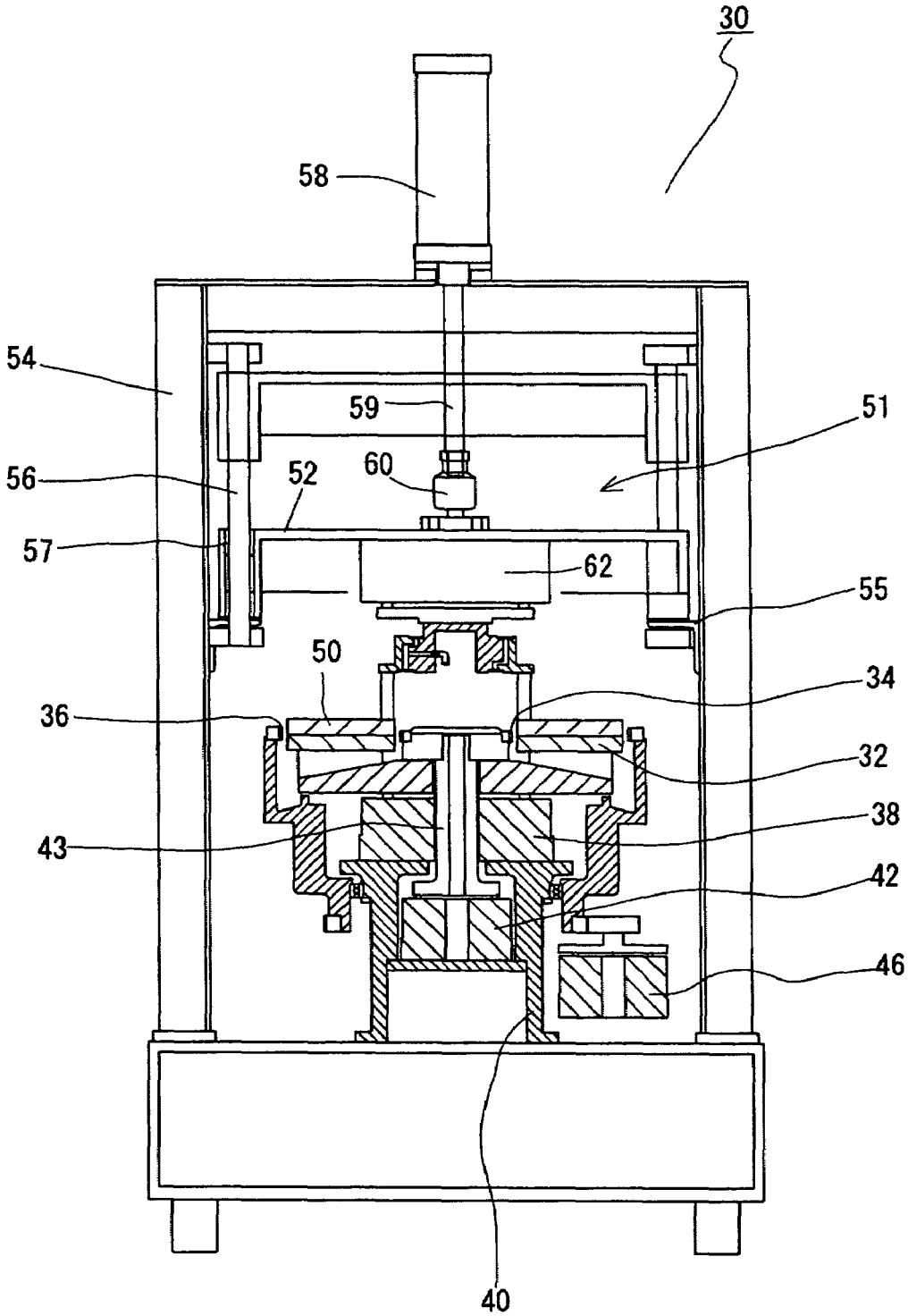
FIG. 1 is a schematic view of a first embodiment of the polishing apparatus of the present invention.
Figure 2:
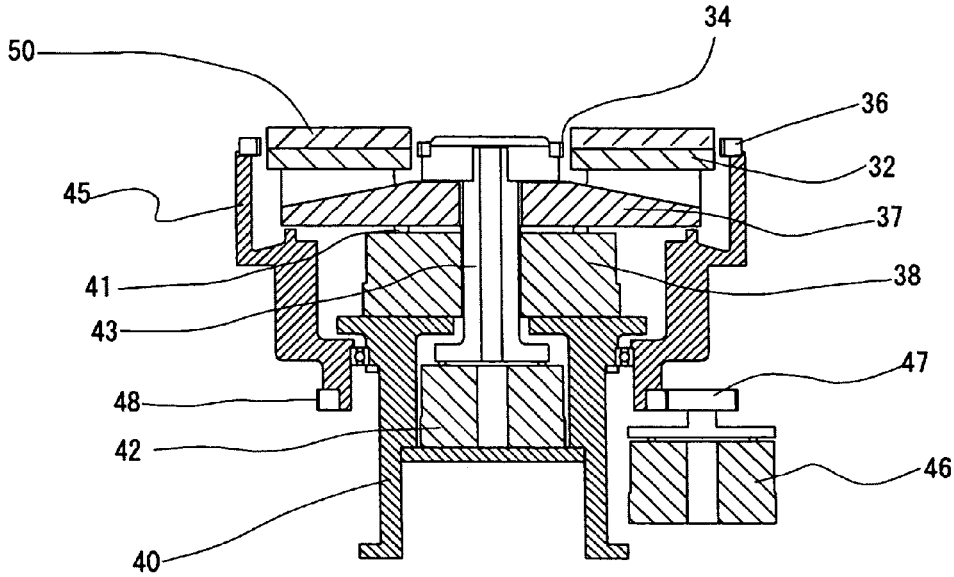
FIG. 2 is an explanation view of a driving mechanism for driving a lower polishing plate shown in FIG. 1.

FIG. 1 is a schematic view of a polishing apparatus 30. FIG. 2 is a driving mechanism for driving a lower polishing plate 32, a sun gear 34 and an internal gear 36.

Firstly, the driving mechanism for driving the lower polishing plate 32, etc. will be explained with reference to FIG. 2.

The lower polishing plate 32 is mounted and fixed on a holder 37. The holder 37 is rotated by a known direct drive motor (DD motor) 38, so that the lower polishing plate 32 can be rotated in a horizontal plane. The DD motor 38 directly rotates a driven member without a reduction gear unit. The DD motor 38 has a donut-shaped or a hollow structure. The DD motor 38 is provided on a holding table 40, and the holder 37 is fixed to a rotary ring 41 of the DD motor 38 by bolts (not shown).

The sun gear 34 is fixed to a shaft 43 and rotated by a DD motor 42, which is provided in a mid part of the holding table 40. The shaft 43 is pierced through a hollow part of the DD motor 38. Since the DD motors 38 and 42 are coaxially arranged, the polishing apparatus 30 can be made compact. The internal gear 36 is fixed to an upper end of a rotary ring 45, which is rotatably supported by the holding table 40. The rotary ring 45 is rotated by a DD motor 46 via gears 47 and 48, so that the internal gear 36 can be rotated.

Figure 7:
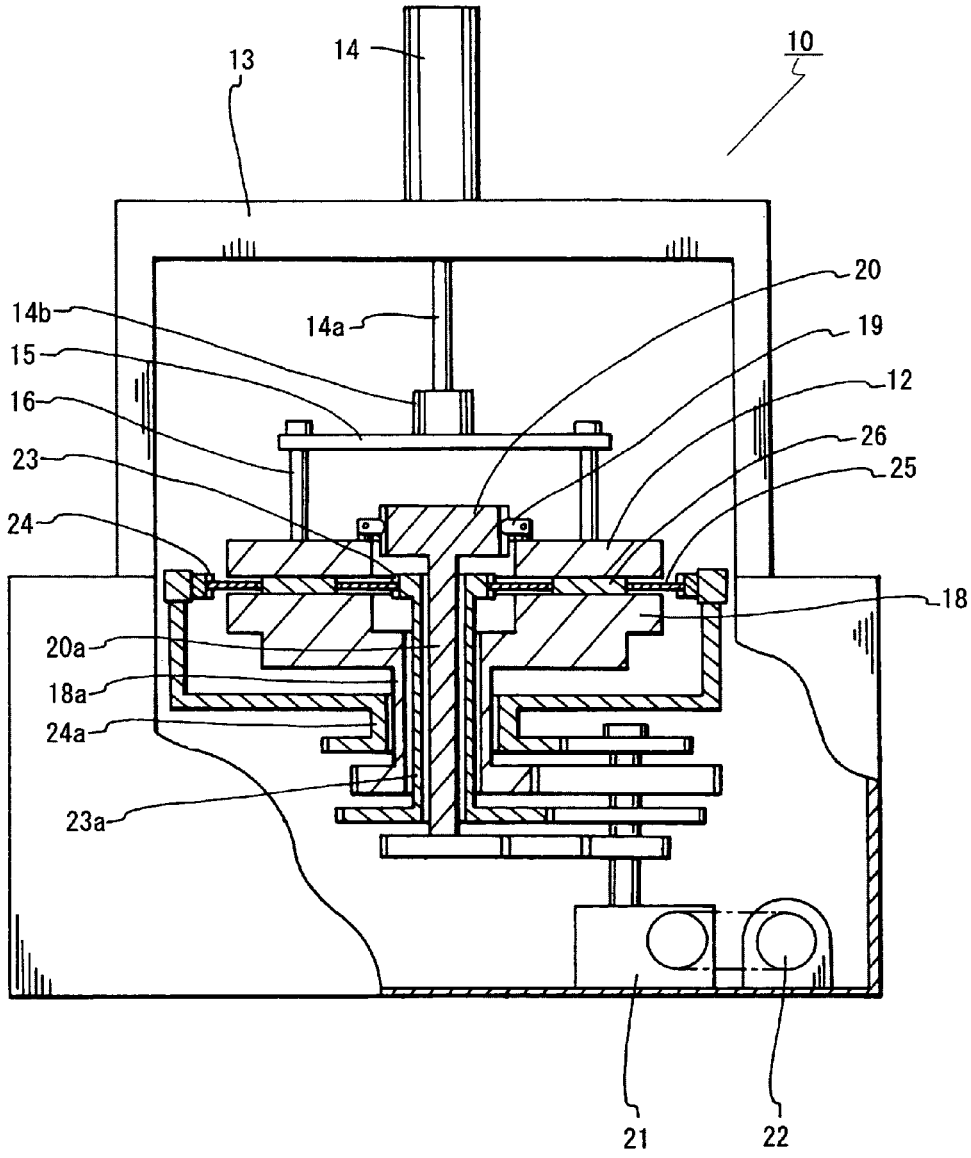
FIG. 7 is a schematic view of the conventional polishing apparatus.

An upper polishing plate 50 is held and allowed to rotate and vertically move by a holding mechanism 51. A carrier 25 (see FIG. 7) is provided between the lower polishing plate 32 and the upper polishing plate 50 and engaged with the sun gear 34 and the internal gear 36. Work pieces 26 (see FIG. 7) are respectively set in through-holes (not shown) of the carrier 25.

Next, the holding mechanism 51 will be explained with reference to FIGS. 1 and 3.

In FIG. 1, a movable plate 52 has cylindrical guide sections 57. The guide sections 57 are guided by guide poles 56, which are vertically provided to a frame 54, so that the movable plate 52 can be moved upward and downward.

A vertical drive unit (ex. cylinder unit) 58 is located above the upper polishing plate 50 and fixed to an upper part of the frame 54. A rod 59 of the vertical drive unit 58 is connected to the movable plate 52 by a coupler 60, so that the vertical drive unit 58 is capable of vertically moving the movable plate 52.

Stoppers 55 make the movable plate 52 stop at a prescribed position when the movable plate 52 is moved downward by the cylinder unit 58.

A DD motor 62 is fixed on a bottom face of the movable plate 52. As shown in FIG. 3, the DD motor 62 rotates the upper polishing plate 50 in a horizontal plane together with a rotary plate 63, an inner member 64, a first elastic member 70, a second elastic member 72, an outer member 65, connecting members 66, etc..

The rotary plate 63 is fixed to a rotary ring 67 of the DD motor 62 by bolts (not shown).

The inner member 64 is fixed to a bottom face of the rotary plate 63 by bolts (not shown) and rotated about a vertical axis together with the rotary plate 63.

The inner member 64 is formed into an inverted cup-shape, and its lower end is opened. A small diameter part 64*a*, a medium diameter part 64*b* and a large diameter part 64*c* are formed in an outer circumferential face of the inner member 64 in that order. A step face 64*d* is formed between the small diameter part 64*a* and the medium diameter part 64*b*; another step face 64*e* is formed between the medium diameter part 64*b* and the large diameter part 64*c*.

The outer member 65 is formed into a hollow shape and has an upper open end and a lower open end. The inner member 64 is accommodated in the hollow outer member 65.

An upper flange 65*a* is extended from an inner edge of the upper open end of the outer member 65 toward the medium diameter part 64*b* of the inner member 64; a lower flange 65*b* is outwardly extended from an outer edge of the lower open end of the outer member 65.

The first elastic member 70 is made of an elastic material, e.g., rubber, and formed into a ring-shape with a prescribed width. The first elastic member 70 connects the upper part (the step face 64*d*) of the inner member 64 to the upper part (an upper face of the upper flange 65*a*) of the outer member 65 and closes the upper open end of the outer member 65. The first elastic member 70 is fixed the upper parts by, for example, an adhesive and bolts. A ring-shaped space is formed between an outer circumferential face of the medium diameter part 64*b* and an inner circumferential face of the upper flange 65*a*.

The second elastic member 72 is made of an elastic material, e.g., rubber, and formed into a ring-shape with a prescribed width. The second elastic member 72 connects the lower part of the inner member 64 to the lower part of the outer member 65 and closes the lower open end of the outer member 65. The second elastic member 72 is fixed the lower parts by, for example, an adhesive and bolts. A ring-shaped space is formed between an outer circumferential face of the large diameter part 64*c* and an inner circumferential face of the outer member 65.

Note that, in the present embodiment, the diameter of the second elastic member 72 is greater than that of the first elastic member 70.

With this structure, a first closed space 73 is formed between the outer circumferential face of the inner member 64 and an inner circumferential face of the outer member 65 and closed by the first and second elastic members 70 and 72.

By forming the first closed space 73, the outer member 65 is capable of vertically displacing with respect to the inner member 64 without contact.

Figure 3:
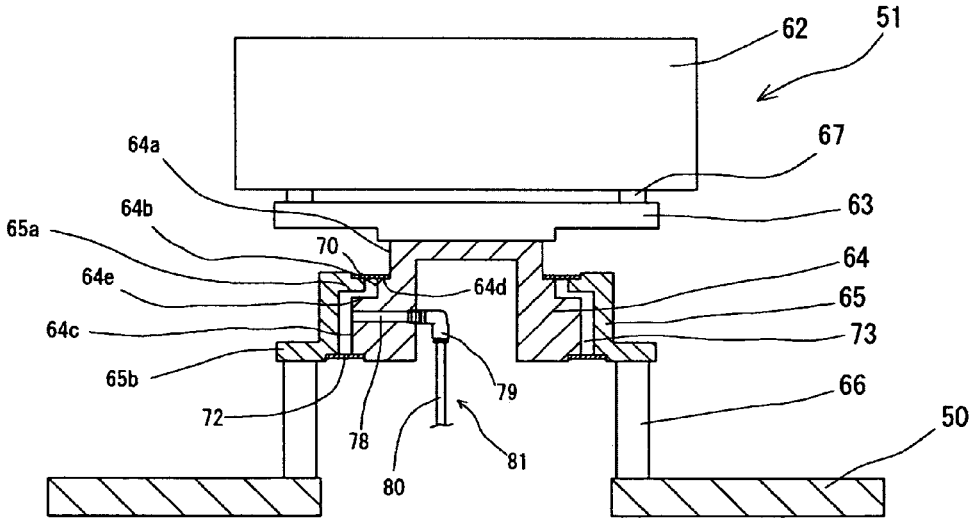
FIG. 3 is an explanation view of a holding mechanism for holding an upper polishing plate shown in FIG. 1.

A pressurized fluid, e.g., compressed air, can be supplied into and discharged from the first closed space 73 via a fluid path 78 of the inner member 64, a joint 79 and a hose 80 (see FIG. 3). The hose 80 is connected to a rotary joint (not shown) provided in the coupler 60 via a pipe (not shown) provided in a hollow part of the DD motor 62. The rotary joint is connected to an external pressure source, e.g., compressor. A fluid supply section 81 is constituted by the fluid path 78, the joint 79, the hose 80, the rotary joint, etc..

When a lower face of the flange 65*a* contacts the step face 64*e*, a downward movement of the outer member 65 is restrained. Namely, the lower face of the flange 65*a* and the step face 64*e* constitute an engage section.

When the cylinder unit 58, which acts as a vertical drive unit, upwardly moves the movable plate 52 together with the inner member 64, the outer member 65 and the upper polishing plate 50 are moved upward due to the engage section. Note that, the engage section is not limited to the lower face of the flange 65*a* and the step face 64*e*, other parts, which can be mutually engaged, may be used as the engage section.

The connecting members 66 are rods, which connect a lower face of the flange 65*b* with an upper face of the upper polishing plate 50. With this structure, the upper polishing plate 50 can be vertically moved together with the outer member 65.

Next, a method of polishing work pieces 26 will be explained.

The work pieces 26 are respectively set in the thorough-holes of the carrier 25.

Then, the pressurized fluid is supplied into the first closed space 73 from the fluid supply section 81. The vertical drive unit 58 is driven so as to downwardly move the upper polishing plate 50 until facing the lower polishing plate 32 or reaching a stop position, at which the movement of the movable plate 52 is stopped by the stoppers 55.

As described above, the diameter of the first elastic member 70 is smaller than that of the second elastic member 72. As clearly shown in FIG. 3, in the closed space 73, a pressure receiving area, which receives fluid pressure for moving the outer member 65 upward (a first pressing force), is broader than the other pressure receiving area, which receives the fluid pressure for moving the outer member 65 downward (a second pressing force). Therefore, the outer member 65 is biased upward by a third pressing force, which is generated by the difference between the first pressing force and the second pressing force. The third pressing force, which presses the work pieces 26, is smaller than weight of the upper polishing plate 50 (exactly, sum of weight of the upper polishing plate 50, the connecting members 66 and the outer member 65).

Since the inner member 64 is fixed to the rotary plate 63, the inner member 64 is not moved even if the second pressing force works in the closed space 73. In the closed space 73, the fluid pressure uniformly works in every direction. However, the inner member 64 is fixed and the outer member 65 is movable, further the pressure receiving areas for generating the first and second pressing forces are different, so that the third pressing force can be applied to the movable outer member 65.

In an early stage of polishing the work pieces 26, fine projections and concaves exist in surfaces of the work pieces. Preferably, the work pieces 26 are polished with relatively small pressing force. Therefore, in the early stage, the high pressure fluid is supplied into the first closed space 73 so as to increase the first pressing force and reduce the third pressing force applied to the work pieces 26. Then, the DD motor 62 is driven to rotate the upper polishing plate 50. Further, slurry is supplied from a slurry supply section (not shown) so as to polish the work pieces 26 with the slurry.

A torque of the DD motor 62 is transmitted to the upper polishing plate 50 via the rotary plate 63, the inner member 64, the first and second elastic members 70 and 72, the outer member 65 and the connecting members 66.

By supplying the high pressure fluid into the first closed space 73 in the early stage of the polish, the first and second elastic members 70 and 72 are outwardly expanded and made rigid. A relatively great driving force is required to rotate the upper polishing plate 50 from a resting state, so the rigid elastic members 70 and 72 are suitably used.

With advancing the polish, the pressure of the fluid supplied into the first closed space 73 is reduced and the third pressing force applied to the work pieces 26 is increased so as to raise polishing rate. The maximum third pressing force applied to the work pieces 26 is equal to weight of the upper polishing plate 50.

Figure 4:
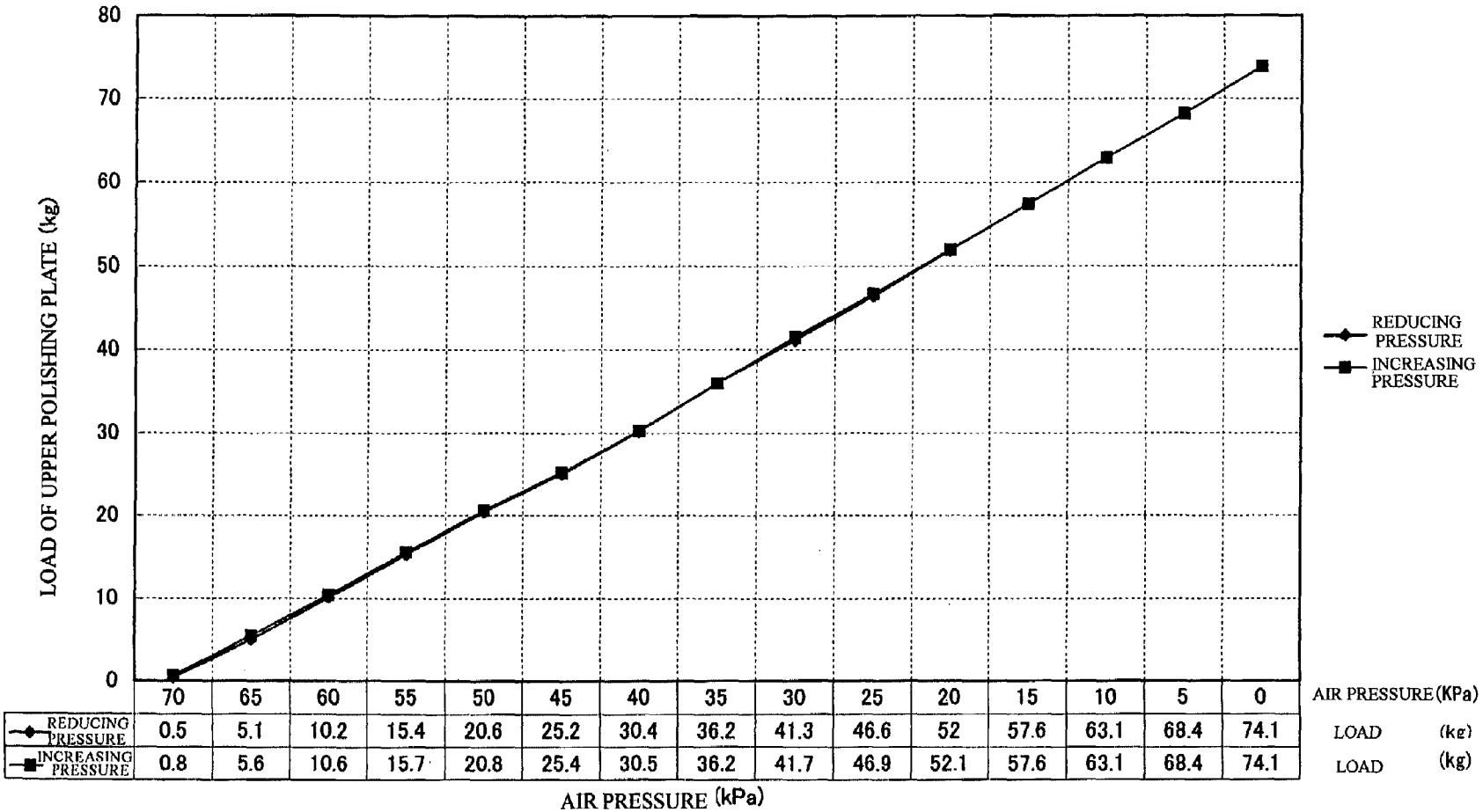
FIG. 4 is a graph showing a relationship between fluid pressure in a first closed space and a load of the upper polishing plate.

In the present embodiment, the outer member 65 is displaced without contacting the inner member 64, so that knocking, which is caused by using the conventional cylinder unit, can be prevented. Therefore, the third pressing force, which is applied from the upper polishing plate 50 to the work pieces 26, can be linearly and precisely controlled. Especially, thin work pieces can be suitably polished. FIG. 4 is a graph showing a relationship between the fluid pressure in the first closed space 73 and a load of the upper polishing plate 50. According to FIG. 4, the load of the upper polishing plate 50 was linearly varied. In FIG. 4, "AIR PRESSURE (KPa)" means air pressure in the closed space 73; "REDUCING PRESSURE" means the actual load of the upper polishing plate 50 which was measured when the air pressure in the closed space 73 was reduced; and "INCREASING PRESSURE" means the actual load of the upper polishing plate 50 which was measured when the air pressure in the closed space 73 was increased.

When the fluid pressure in the first closed space 73 is reduced to increase the polishing rate, the expansion of the first and second elastic members 70 and 72 are loosened and relatively softened. But the softened elastic members 70 and 72 do not badly influence the continuous rotation of the upper polishing plate 50, and they suitably absorb vibrations of the upper polishing plate 50 rotating at high speed.

As described above, the DD motors are employed to rotate the upper polishing plate 50, etc., so that backlashes of the gears and the keys can be reduced. By restraining vibrations of parts, thin work pieces can be polished without damaging.

In the first embodiment, the first pressing force, which is generated in the first closed space 73 and biases the outer member 65 upward, is greater than the second pressing force, which is generated in the first closed space 73 and biases the outer member 65 downward. Therefore, a range of the third pressing force, which presses the work pieces 26, is from a force smaller than a weight of the upper polishing plate 50 to a force equal to the weight thereof.

Figure 5:
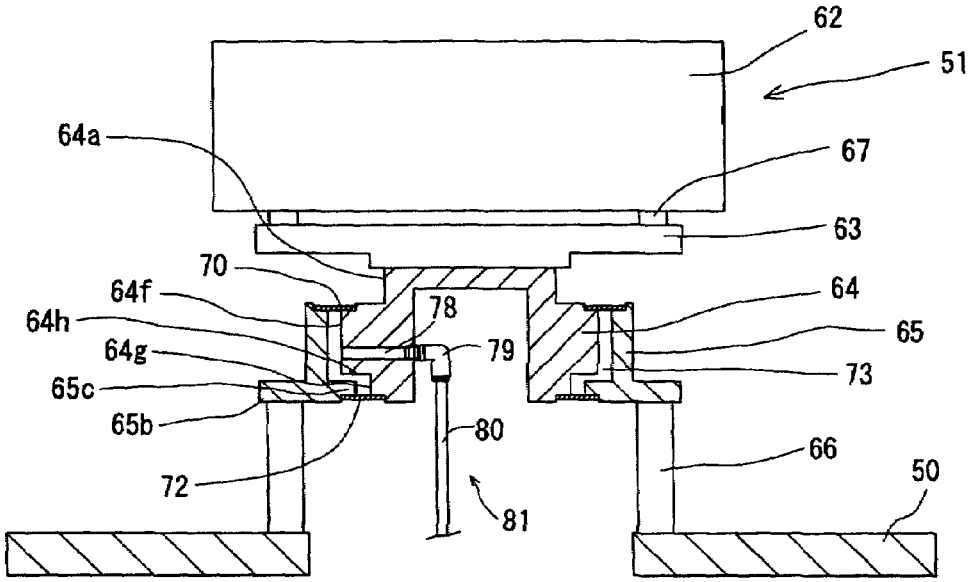
FIG. 5 is an explanation view of a press mechanism of the upper polishing plate of a second embodiment.

A second embodiment will be explained with reference to FIG. 5. Note that, the structural elements used in the first embodiment are assigned the same symbols and explanation will be omitted.

In the second embodiment, the first pressing force, which biases the outer member 65 upward, is smaller than the second pressing force, which biases the outer member 65 downward. A range of the third pressing force, which presses the work pieces 26, is from a force greater than a weight of the upper polishing plate 50 to a force equal to the weight thereof.

A mid part of the inner member 64 is a large diameter part 64*f*, and a lower part is a medium diameter part 64*g*. A lower flange 65*c* is inwardly extended from a lower part of the outer member 65. A bottom face of the lower flange 65*c* and a bottom face of the medium diameter part 64*g* are connected by the second elastic member 72. The first closed space 73 is formed between outer circumferential faces of the large diameter part 64*f* and the medium diameter part 64*g* and the inner circumferential face of the outer member 65. A step face 64*h* is formed between the large diameter part 64*f* and the medium diameter part 64*g*.

A torque of the DD motor 62 is transmitted to the upper polishing plate 50 by the elastic members 70 and 72. By employing the elastic members 70 and 72, the upper polishing plate 50 is capable of following an upper face of the lower polishing plate 32, so that the suitable mechanism, e.g., universal joint, for rotating the upper polishing plate 50 along the upper face of the lower polishing plate 32, which is used in the conventional polishing apparatus, can be omitted. Namely, the polishing apparatus can be simplified.

The torque of the DD motor 62 may be transmitted to the upper polishing plate 50 by not only the elastic members 70 and 72 but also other suitable means. For example, a transmission pin which is engaged with the outer member 65, may be provided to the rotary plate 63 so as to transmit the torque of the DD motor 62 to the upper polishing plate 50. In this case, the outer member 65 is capable of vertically displacing. Note that, rigidity of the elastic members 70 and 72 need not be considered.

Figure 6:
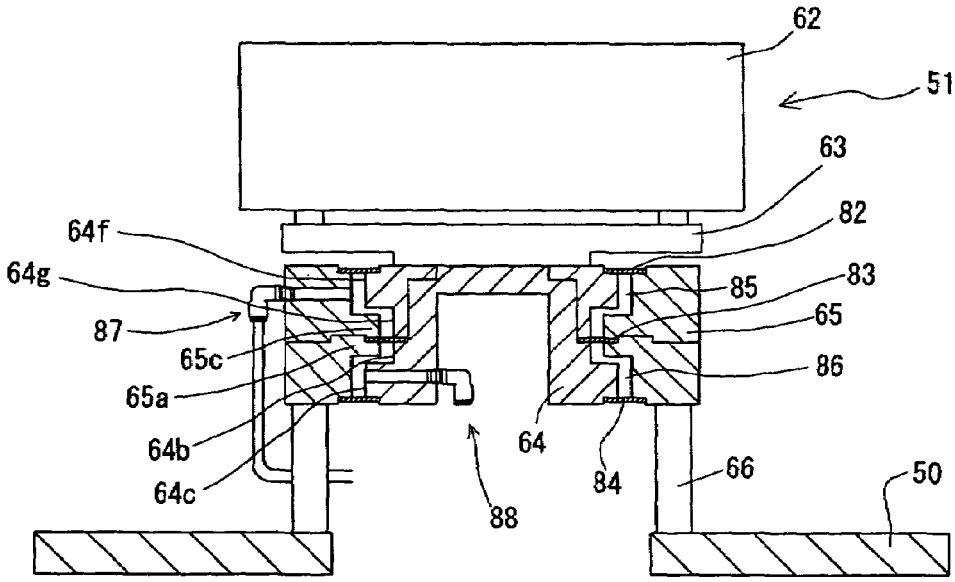
FIG. 6 is an explanation view of a press mechanism of the upper polishing plate of a third embodiment.

A third embodiment will be explained with reference to FIG. 6. Note that, the structural elements used in the former embodiments are assigned the same symbols and explanation will be omitted.

The polishing apparatus of the third embodiment has the features of the first and second embodiments.

Namely, a third elastic member 82, which is made of an elastic material and formed into a ring-shape with a prescribed width, connects the upper part of the inner member 64 and the upper part of the outer member 65 and closes the upper open end of the outer member 65; a fourth elastic member 83, which is made of an elastic material and formed into a ring-shape with a prescribed width, connects a mid part of the inner member 64 and a mid part of the outer member 65 and closes a gap therebetween; and a fifth elastic member 84, which is made of an elastic material and formed into a ring-shape with a prescribed width, connects the lower part of the inner member 64 and the lower part of the outer member 65 and closing the lower open end of the outer member 65. A second closed space 85 is formed between the outer circumferential face of the inner member 64, the inner circumferential face of the outer member 65 and closed by the third and fourth elastic members 82 and 83; a third closed space 86 is formed between the outer circumferential face of the inner member 64, the inner circumferential face of the outer member 65 and closed by the fourth and fifth elastic members 83 and 84. A first fluid supply section 87 supplies the pressurized fluid into the second closed space 85; a second fluid supply section 88 supplies the pressurized fluid into the third closed space 86. The fluid supply sections 87 and 88 may be connected to rotary joints as well as the first embodiment. The fluid supply sections 87 and 88 are capable of independently supplying and discharging the pressurized fluids.

To polish the work pieces 26, firstly the vertical drive unit 58 downwardly moves the upper polishing plate 50 until facing the lower polishing plate 32. The DD motor 62 rotates the upper polishing plate 50, in a horizontal plane, with the inner member 64, the elastic members 82, 83 and 84, the outer member 65 and the connecting members 66. Slurry is supplied onto the upper polishing plate 50 from a slurry supply section (not shown). By supplying the pressurized fluids into and discharging the same from the second closed space 85 and/or the third closed space 86 by the fluid supply sections 87 and 88, the third pressing force pressing the work pieces 26 can be adjusted while polishing the work pieces 26. Note that, as described above, the third pressing force of the upper polishing plate 50 (exactly, the upper polishing plate 50, the connecting members 66 and the outer member 65) is equal to the difference between the first pressing force biasing the outer member 65 upward and the second pressing force biasing the outer member 65 downward, which are generated in the second closed space 85 and/or the third closed space 86.

In the present embodiment, pressure receiving areas in the closed spaces 85 and 86 are determined so as to make the first pressing force in the second closed space 85 greater than the second pressing force therein and make the first pressing force in the third closed space 86 smaller than the second pressing force therein. Therefore, the third pressing force can be adjusted between a force smaller than the weight of the upper polishing plate 50 and a force greater than the weight thereof while polishing the work pieces 26.

In another case, the pressure receiving areas in the closed spaces 85 and 86 may be determined so as to make the first pressing force in the second closed space 85 smaller than the second pressing force therein and make the first pressing force in the third closed space 86 greater than the second pressing force therein. Therefore, the third pressing force of the upper polishing plate 50 can be adjusted between the force greater than the weight of the upper polishing plate 50 and the force smaller than the weight thereof while polishing the work pieces 26.

In the both cases, the third pressing force applied to the work pieces 26 may be precisely controlled by simultaneously controlling pressure of the fluids supplied into the second and third closed spaces 85 and 86.

In the above described embodiments, the inner member 64 is fixed to the DD motor 62 and rotated so as to transmit the torque to the outer member 65. In another case, the outer member 65 may be fixed to the DD motor 62, the inner member 64 may be connected to the upper polishing plate 50 by suitable means (not shown), the torque of the outer member 65 may be transmitted to the inner member 64 via elastic members or a transmission pin, and the torque may be further transmitted to the upper polishing plate 50 via a suitable connecting member.

In the above described embodiments, the vertical drive unit 58 is the cylinder unit. The vertical drive unit is not limited to the cylinder unit. For example, a mechanism constituted by a motor, a ball screw, etc. may be employed.

In some cases, the lower polishing plate 32 may be vertically moved instead of the upper polishing plate 50.

Further, the polishing apparatus may polish one surface of each work piece 26. In another case, the polishing apparatus may polish both surfaces of each work piece 26. The polishing apparatus includes the one which have the upper and lower polishing plates with a polishing cloth on the polishing surface thereof.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing apparatus, comprising:

a lower polishing plate;

an upper polishing plate being relatively moved with respect to said lower polishing plate so as to polish a work piece clamped between said lower polishing plate and upper polishing plate; and a holding mechanism for holding said upper polishing plate, wherein said holding mechanism includes:

an inner member;

an outer member having an upper open end and a lower open end, said outer member accommodating said inner member;

a first elastic member being made of an elastic material and formed into a ring-shape with a prescribed width, said first elastic member connecting an upper part of said inner member and an upper part of said outer member and closing the upper open end of said outer member;

a second elastic member being made of an elastic material and formed into a ring-shape with a prescribed width, said second elastic member connecting a lower part of said inner member and a lower part of said outer member and closing the lower open end of said outer member;

a first closed space being enclosed by an outer face of said inner member, an inner face of said outer member, said first elastic member and said second elastic member; and a fluid supply section supplying a pressurized fluid into said first closed space, one of said inner member and said outer member is connected to a rotary drive unit, the other is connected to said upper polishing plate, and said upper polishing plate is rotated in a horizontal plane, by said rotary drive unit, with said inner member and said outer member, and a pressure difference between a first pressing force pressing said outer member or said inner member upward and a second pressing force pressing said outer member or said inner member downward, which is produced in said first closed space by supplying the compressed fluid into and discharging the same from said first closed space, is adjusted so as to adjust a third pressing force of said upper polishing plate, which presses the work piece, while polishing the work piece.

2. A polishing apparatus, comprising:

a lower polishing plate;

an upper polishing plate being relatively moved with respect to said lower polishing plate so as to polish a work piece clamped between said lower polishing plate and upper polishing plate; and a holding mechanism for holding said upper polishing plate, wherein said holding mechanism includes:

an inner member;

an outer member having an upper open end and a lower open end, said outer member accommodating said inner member;

a first elastic member being made of an elastic material and formed into a ring-shape with a prescribed width, said first elastic member connecting an upper part of said inner member and an upper part of said outer member and closing the upper open end of said outer member;

a second elastic member being made of an elastic material and formed into a ring-shape with a prescribed width, said second elastic member connecting a lower part of said inner member and a lower part of said outer member and closing the lower open end of said outer member;

a first closed space being enclosed by an outer face of said inner member, an inner face of said outer member, said first elastic member and said second elastic member;

a fluid supply section supplying a pressurized fluid into said first closed space;

a rotary drive unit to which one of said inner member and said outer member is connected;

a connecting member connecting the other of said inner member and said outer member to said upper polishing plate; and a vertical drive unit being provided above said upper polishing plate, said vertical drive unit vertically moving said rotary drive unit and said upper polishing plate with respect to said lower polishing plate, and said upper polishing plate is downwardly moved to face said lower polishing plate by said vertical drive unit, said upper polishing plate is rotated in a horizontal plane, by said rotary drive unit, with said inner member, said outer member and said connecting member, and a pressure difference between a first pressing force pressing said outer member or said inner member upward and a second pressing force pressing said outer member or said inner member downward, which is produced in said first closed space by supplying the compressed fluid into and discharging the same from said first closed space, is adjusted so as to adjust a third pressing force of said upper polishing plate, which presses the work piece, while polishing the work piece.

3. The polishing apparatus according to claim 2, wherein the first pressing force is greater than the second pressing force, and a range of the third pressing force is from a force smaller than a weight of said upper polishing plate to a force equal to the weight thereof.

4. The polishing apparatus according to claim 2, wherein the first pressing force is smaller than the second pressing a force, and a range of the third pressing force is from a force greater than a weight of said upper polishing plate to a force equal to the weight thereof.

5. The polishing apparatus according to claim 2, wherein a torque for rotating one of said inner member and said outer member is transmitted to the other by said first elastic member and said second elastic member.

6. The polishing apparatus according to claim 2, wherein a torque for rotating one of said inner member and said outer member is transmitted to the other by a transmission pin.

7. A polishing apparatus, comprising:

a lower polishing plate;

an upper polishing plate being relatively moved with respect to said lower polishing plate so as to polish a work piece champed between said lower polishing plate and upper polishing plate; and a holding mechanism for holding said upper polishing plate, wherein said holding mechanism includes:

an inner member;

an outer member having an upper open end and a lower open end, said outer member accommodating said inner member;

a first elastic member being made of an elastic material and formed into a ring-shape with a prescribed width, said first elastic member connecting an upper part of said inner member and an upper part of said outer member and closing the upper open end of said outer member;

a second elastic member being made of an elastic material and formed into a ring-shape with a prescribed width, said second elastic member connecting a mid part of said inner member and a mid part of said outer member and closing a gap therebetween;

a third elastic member being made of an elastic material and formed into a ring-shape with a prescribed width, said third elastic member connecting a lower part of said inner member and a lower part of said outer member and closing the lower open end of said outer member;

a first closed space being enclosed by an outer face of said inner member, an inner face of said outer member, said first elastic member and said fourth elastic member;

a second closed space being enclosed by the outer face of said inner member, the inner face of said outer member, said second elastic member and said third elastic member;

a first fluid supply section supplying a pressurized fluid into said first closed space; and a second fluid supply section supplying a pressurized fluid into said second closed space, one of said inner member and said outer member is connected to a rotary drive unit, the other is connected to said upper polishing plate, and said upper polishing plate is rotated in a horizontal plane, by said rotary drive unit, with said inner member, said outer member and a connecting member, and a pressure difference between a first pressing force pressing said outer member or said inner member upward and a second pressing force pressing said outer member or said inner member downward, which is produced in said first closed space and/or said second closed space by supplying the compressed fluid into and discharging the same from said first closed space and/or said second closed space, is adjusted so as to adjust a third pressing force of said upper polishing plate, which presses the work piece, while polishing the work piece.

8. A polishing apparatus, comprising:

a lower polishing plate;

an upper polishing plate being relatively moved with respect to said lower polishing plate so as to polish a work piece clamped between said lower polishing plate and upper polishing plate; and a holding mechanism for holding said upper polishing plate, wherein said holding mechanism includes:

an inner member;

an outer member having an upper open end and a lower open end, said outer member accommodating said inner member;

a first elastic member being made of an elastic material and formed into a ring-shape with a prescribed width, said first elastic member connecting an upper part of said inner member and an upper part of said outer member and closing the upper open end of said outer member;

a second elastic member being made of an elastic material and formed into a ring-shape with a prescribed width, said second elastic member connecting a mid part of said inner member and a mid part of said outer member and closing a gap therebetween;

a third elastic member being made of an elastic material and formed into a ring-shape with a prescribed width, said third elastic member connecting a lower part of said inner member and a lower part of said outer member and closing the lower open end of said outer member;

a first closed space being enclosed by an outer face of said inner member, an inner face of said outer member, said first elastic member and said second elastic member;

a second closed space being enclosed by the outer face of said inner member, the inner face of said outer member, said second elastic member and said third elastic member;

a first fluid supply section supplying a pressurized fluid into said first closed space;

a second fluid supply section supplying a pressurized fluid into said second closed space;

a rotary drive unit to which one of said inner member and said outer member is connected;

a connecting member connecting the other of said inner member and said outer member to said upper polishing plate; and a vertical drive unit being provided above said upper polishing plate, said vertical drive unit vertically moving said rotary drive unit and said upper polishing plate with respect to said lower polishing plate, and said upper polishing plate is downwardly moved to face said lower polishing plate by said vertical drive unit, said upper polishing plate is rotated in a horizontal plane, by said rotary drive unit, with said inner member, said outer member and said connecting member, and a pressure difference between a first pressing force pressing said outer member or said inner member upward and a second pressing force pressing said outer member or said inner member downward, which is produced in said first closed space and/or said second closed space by supplying the compressed fluid into and discharging the same from said first closed space and/or said second closed space, is adjusted so as to adjust a third pressing force of said upper polishing plate, which presses the work piece, while polishing the work piece.

9. The polishing apparatus according to claim 8, wherein the first pressing force generated in said first closed space is greater than the second pressing force therein, and the first pressing force generated in said second closed space is smaller than the second pressing force therein, whereby a range of the third pressing force is from a force smaller than a weight of said upper polishing plate to a force greater than the weight thereof.

10. The polishing apparatus according to claim 8, wherein the first pressing force generated in said first closed space is smaller than the second pressing force therein, and the first pressing force generated in said second closed space is greater than the second pressing force therein, whereby a range of the third pressing force is from a force greater than a weight of said upper polishing plate to a force smaller than the weight thereof.

11. The polishing apparatus according to claim 2, wherein an engage section, which is capable of restraining relative downward displacement of said inner member and said outer member, is provided between said inner member and said outer member.

12. The polishing apparatus according to claim 2, wherein said rotary drive unit is a direct drive motor.

* * * * *